US008142075B2

(12) United States Patent
Shaw

(10) Patent No.: US 8,142,075 B2
(45) Date of Patent: Mar. 27, 2012

(54) FOLDABLE BLANK IN USE WITH A BAG MATERIAL FOR SECURING AND RETAINING ARTICLES OF EVIDENCE IN TAMPER-EVIDENT FASHION AND INCLUDING SIDE CONFIGURED EVIDENCE RE-ENTRY LOCATIONS WITH ADDITIONAL TAMPER EVIDENT RECLOSURE AND RECORDING FEATURES

(76) Inventor: Raymond R. Shaw, Farmington Hills, MI (US)

( * ) Notice: Subject to any disclaimer, the term of this patent is extended or adjusted under 35 U.S.C. 154(b) by 1022 days.

(21) Appl. No.: 12/023,792

(22) Filed: Jan. 31, 2008

(65) Prior Publication Data

US 2008/0181538 A1 Jul. 31, 2008

Related U.S. Application Data

(63) Continuation-in-part of application No. 10/891,347, filed on Jul. 14, 2004, now abandoned.

(51) Int. Cl.
*B65D 33/34* (2006.01)
*B65D 33/18* (2006.01)

(52) U.S. Cl. ..... 383/5; 383/15; 383/34

(58) Field of Classification Search ..... 383/5, 34, 383/15, 211

See application file for complete search history.

(56) References Cited

U.S. PATENT DOCUMENTS

| | | | | |
|---|---|---|---|---|
| 376,005 | A | | 1/1888 | Manahan |
| 526,799 | A | | 10/1894 | Barnard |
| 1,987,751 | A | | 1/1935 | Sahm |
| 2,175,387 | A | | 10/1939 | Goding |
| 2,192,131 | A | * | 2/1940 | Fishwick ..... 383/15 |
| 2,385,576 | A | | 9/1945 | Israel |
| 3,460,742 | A | * | 8/1969 | Langdon ..... 206/439 |
| 3,806,984 | A | * | 4/1974 | Hilsabeck ..... 294/1.3 |
| 3,865,304 | A | | 2/1975 | Mojonnier et al. |
| 4,175,604 | A | | 11/1979 | Bonner |
| 4,384,670 | A | | 5/1983 | Dicker |
| 4,479,588 | A | | 10/1984 | Davis et al. |
| 4,566,129 | A | | 1/1986 | McNamee |
| 4,573,634 | A | | 3/1986 | Kohler et al. |

(Continued)

FOREIGN PATENT DOCUMENTS

JP 3100478 A 4/1991

(Continued)

*Primary Examiner* — Nathan J Newhouse
*Assistant Examiner* — Christopher Demeree
(74) *Attorney, Agent, or Firm* — Gifford, Krass, Sprinkle, Anderson & Citkowski, P.C.

(57) ABSTRACT

A tamper-evident evidence bag including a blank having first and second planar shaped and pivotally connected panels. The bag has an open perimeter edge and is secured to first selected lacing surfaces of the pivotally connected panels and such that an interior of the bag is communicable through an aperture defined between the panels. The first and second panels are folded from an open position, in which they panels are established in a substantially parallel relationship, to a closed position in which opposingly facing surfaces of are adhered against one another and in order to maintain, in tamper-evident fashion, items placed within the bag enclosure. Additional tamper-evident resealing structure is located along at least one facing side of the associated bag material, allowing documentable re-entry of the pre-sealed evidence bag. The tamper-evident resealing structure includes a re-closable and adhesives peel away flap, a reverse face of includes recordable information fields for documenting the particulars of the re-entry and subsequent tamper evident-resealing event.

4 Claims, 7 Drawing Sheets

U.S. PATENT DOCUMENTS 4,580,683 A 4/1986 Gochenour
4,614,297 A 9/1986 Davis et al.
4,653,113 A 3/1987 Taylor
4,655,388 A 4/1987 Fleming
4,752,028 A 6/1988 Ogura
4,874,096 A * 10/1989 Tessera-Chiesa ..... 383/5
4,948,266 A * 8/1990 Bencic ..... 383/34
4,961,503 A * 10/1990 Bell ..... 383/5
5,060,848 A 10/1991 Ewan
5,103,979 A 4/1992 Hustad
5,108,194 A * 4/1992 Raden ..... 383/5
5,148,970 A 9/1992 Johnston
5,186,900 A 2/1993 Jensen et al.
5,265,794 A 11/1993 Johnston
5,364,189 A * 11/1994 Kuge et al. ..... 383/61.2
5,407,277 A * 4/1995 Burke et al. ..... 383/5
5,503,328 A 4/1996 Roccaforte et al.
5,507,428 A 4/1996 Robinson, Jr. et al.
5,606,846 A * 3/1997 Raby et al. ..... 53/415
5,743,392 A * 4/1998 Chapman ..... 206/315.1
5,935,847 A 8/1999 Smith et al.
6,047,883 A 4/2000 Calvert et al.
6,048,008 A 4/2000 Shaw
6,085,903 A 7/2000 Jotcham et al.
6,126,000 A 10/2000 Tung
6,164,821 A * 12/2000 Randall ..... 383/34
6,296,388 B1 * 10/2001 Galomb et al. ..... 383/63
6,338,572 B1 * 1/2002 Schneck ..... 383/205
6,446,861 B1 9/2002 Smith
6,468,611 B1 10/2002 Haskin
6,860,421 B2 3/2005 Lo Duca
6,886,980 B1 5/2005 Diplock
7,267,261 B2 9/2007 Lo Duca
7,510,080 B2 3/2009 Smart et al.
7,614,542 B2 11/2009 Lo Duca
7,717,319 B2 5/2010 Adam
2001/0022318 A1 9/2001 Kaden et al.
2002/0164088 A1 11/2002 Collins
2003/0075593 A1 4/2003 Wood
2004/0007867 A1 1/2004 Vaughan
2005/0117819 A1 * 6/2005 Kingsford et al. ..... 383/203
2005/0145683 A1 7/2005 Alagna et al.
2006/0013512 A1 1/2006 Shaw
2010/0252618 A1 10/2010 Adam et al.

FOREIGN PATENT DOCUMENTS

KR 20-0296792 12/2002

* cited by examiner

94

EVIDENCE

Property/Evidence Envelope: Date: _____ Of _____

From Whom Obtained: _____

Where Obtained: _____

Defendant: _____

Alias: _____ Date of Birth: _____

Address: _____

Social Security No. _____ Birthplace. _____ Date of Offense: _____

Sex: _____ Race: _____ Height. _____ Weight. _____ Hair: _____ Eyes: _____

Co-Defendant No. 3: _____ Co-Defendant No. 3: _____

Complaint No.: _____ Dist. of Arrest: _____ Date/Time _____

Charge: _____ Dist & Arrest No.: _____ Property Book: _____

Evidence: _____

_____

_____

_____

Where Obtained Exactly (i.e. location in residence, auto or on person). _____

_____

Seized by: _____ Assigned to: _____ Purchased by: _____

Amount Paid: _____ Collected by: _____ Assigned by. _____

PERSON RECOVERING EVIDENCE WILL PERSONALLY PLACE IN ENVELOPE AND SEAL

SEALED BY: Signature. _____ Date: _____ Time: _____

Print Name: _____ Assigned: _____

PICKED UP BY: _____ of the Narcotic Branch

Location Picked Up: _____ Date: _____ Time. _____

Witnesses: _____

Lab No.: _____

Received by: _____ Work Unit: _____ Date: _____ Time: _____

Received by: _____ Work Unit: _____ Date: _____ Time: _____

Received by: _____ Work Unit: _____ Date: _____ Time. _____

Received by: _____ Work Unit: _____ Date: _____ Time. _____

FIG - 11

FOLDABLE BLANK IN USE WITH A BAG MATERIAL FOR SECURING AND RETAINING ARTICLES OF EVIDENCE IN TAMPER-EVIDENT FASHION AND INCLUDING SIDE CONFIGURED EVIDENCE RE-ENTRY LOCATIONS WITH ADDITIONAL TAMPER EVIDENT RECLOSURE AND RECORDING FEATURES

CROSS-REFERENCE TO RELATED APPLICATIONS

This Application is a Continuation-in-part of application Ser. No. 10/893,347 filed on Jul. 14, 2004 and entitled Tamper-Evident Bag for Securing and Retaining Evidence.

FIELD OF THE INVENTION

The present invention relates generally to a foldable and reclosable blank having an open center. More particularly, the present invention discloses a blank in use with an attachable bag-like structure for the purpose of providing for secure holding and retention of evidence, such as in particular by law enforcement personnel Additional tamper-evident resealing structure is located along at least one facing side of the associated bag material, and to allow for documentable re-entry of the pre-sealed evidence bag. The tamper-evident resealing structure includes a reclosable and adhesives peel away flap, a reverse face of includes recordable information fields for documenting the particulars of the re-entry and subsequent tamper evident-resealing event.

BACKGROUND OF THE INVENTION

The prior art is well documented with varying examples of storage and retention articles, such including bag-like structures, containers and the like. These articles are configured for a variety of different uses, among these being the storage and retention of solids and fluids for varying applications. One example of a prior art flexible, self-supporting storage bag with hinged and framed closure is disclosed in Randall, U.S. Pat. No. 6,164,821.

It is also known to open a pre-sealed evidence bag, of any random design, through the application of a sharp edged knife or razor blade. In such situations, the individual seeking access to the interiorly held items will subsequently apply a layer of a generally known type of evidence tape over the incision, and additionally may or may not record the particulars associated with the evidence re-entry event, such as by marker upon the surface of the bag.

SUMMARY OF THE INVENTION

The present invention discloses a blank for use with an attachable bag-like structure, such including either a waterproof/non-fluid absorbent or fluid absorbent material, and for the purpose of providing for secure holding and retention of items of evidence. The present invention is particularly suited for use by law enforcement personnel in the collection of evidence for criminal prosecution.

A blank includes first and second planar shaped and pivotally connected panels. In a preferred application, the blank may be constructed either of a paperboard material or plasticized material, and which includes aligning handle cutout portions.

A bag includes an open perimeter edge and is secured to first selected facing surfaces of the pivotally connected panels. Typically, the bag exhibits a plurality of fold lines such that, upon expanding to a full open position, the blank is supported in an upwardly displaced position and such that an interior of the bag is communicable through an aperture defined between the panels.

The first and second panels are folded from an open position, following placement of evidentiary items within an interior of the bag, to a closed position in which opposingly facing surfaces of the panels are adhered against one another in order to maintain, in tamper-evident fashion, items placed within the bag enclosure. An adhesive surface covers at least a portion of at least one opposing surface of a panel and, upon removal of a tear-away strip or like covering, permits the panels to be retrained in a tamper-evident fashion upon being folded together.

Additional tamper-evident resealing structure is located along at least one facing side of the associated bag material, and to allow for documentable re-entry of the pre-sealed evidence bag. The tamper-evident resealing structure includes a reclosable and adhesives peel away flap, a reverse face of which includes recordable information fields for documenting the particulars of the re-entry and subsequent tamper evident-resealing event. In addition to the resealing structure, an evidence entry form is also disclosed, this capable of being secured to such as an opposite surface of the bag material and in order to document the initial evidence entry particulars.

BRIEF DESCRIPTION OF THE DRAWINGS

Reference will now be made to the attached drawings, when read in combination with the following detailed description, wherein like reference numerals refer to like parts throughout the several views, and in which:

FIG. 11 is an illustration of the evidence entry form also referenced in FIG. 7, and such as which is capable of being secured to such as an opposite surface of the bag material in order to document the initial evidence entry particulars.

DETAILED DESCRIPTION OF THE PREFERRED EMBODIMENTS

Figure 1:
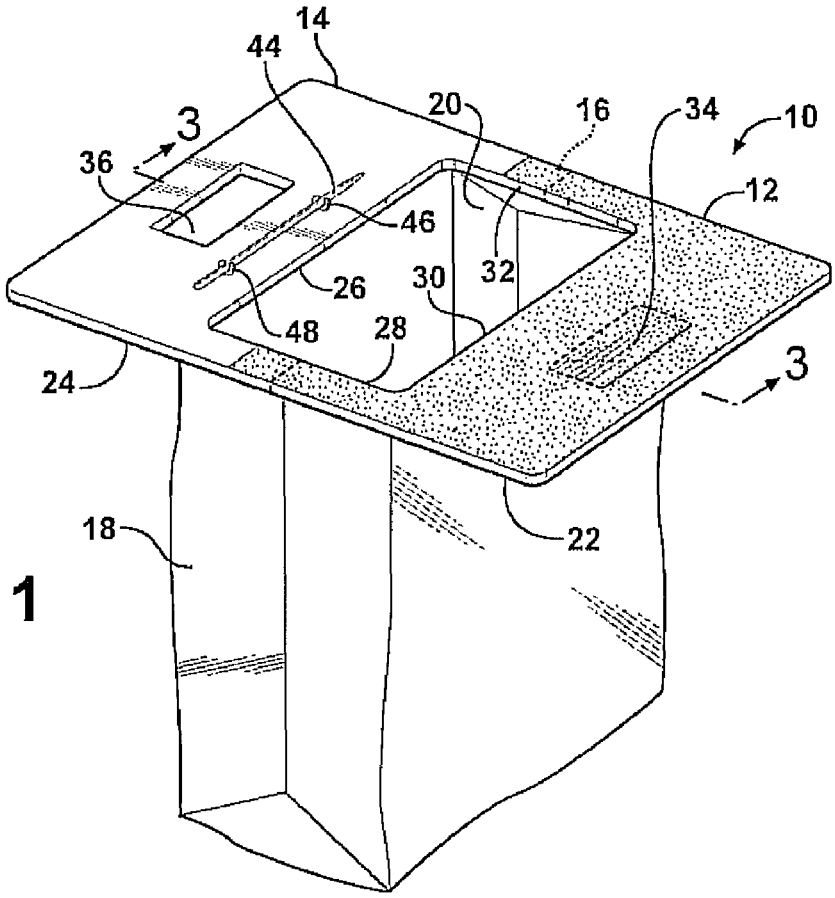
FIG. 1 is a perspective view of a foldable blank incorporated into an evidence bag according to a first preferred embodiment of the present invention.

Referring now to FIG. 1, a tamper-evident evidence bag is illustrated at 10 according to a first preferred embodiment of the present invention. As described previously, the present invention also discloses a blank in use with an attachable bag-like structure for the purpose of providing for secure holding and retention of evidence, such as in particular by law enforcement or crime scene investigation personnel.

As best shown in the illustrations of FIGS. 1-5, the tamper-evident evidence bag 10 includes a blank constructed of a first planar shaped panel 12 and a second panel 14 pivotally attached to the first panel 12 along center line 16. The panels 12 and 14 each typically exhibit a substantially planar and polygonal shape and which are constructed of a paperboard (such as corrugated material for providing strength) or, alternatively, a plasticized or other suitable material exhibiting the necessary properties of strength and durability. The centerline 16 further exhibits a hinge which, as will be subsequently described, facilitates opening and closing of opposing facing surfaces of the panels 12 and 14 in the manner shown in FIGS. 3-5.

A bag 18 having an open perimeter edge (see as referenced at 20 in FIG. 1) is secured to first selected, and underside facing surfaces 22 and 24, of the pivotally connected panels 12 and 14. As illustrated, the bag 18 may be of a conventional paperboard variety and which exhibits a plurality of fold lines such that, upon expanding the bag to a full open position, the blank is supported in an upwardly displaced position, and further such that an interior of the bag 18 is communicable through an aperture (see inwardly facing and rectangular defining side walls 26, 28, 30 and 32) to defined between the panels 12 and 14.

In a preferred application, the bag 18 is constructed of a somewhat fluid absorbent material, this typically being preferred in evidence gathering operations where it is necessary to maintain the integrity of items such as blood or semen covered clothing. In applications such as these, it has been found that a non-breathing, or waterproof/impermeable, material would result in compromising the contained evidence items. In additional applications, it is desired that the bag enclosure exhibit some degree of non-absorbency of fluids, and this may be provided either by substituting the paperboard bag material with another material exhibiting the necessary properties. Alternatively, it is also envisioned that a plasticized film or like suitable insert may be provided for placement within the paperboard bag enclosure in order to establish the necessary retention properties.

Referring again to FIGS. 1 and 2, the panels 12 and 14 each include aligning and cutout portions, see at 34 for panel 12 and at 36 for panel 14. In particular, and in a preferred embodiment, the cutout portion 34 is provided as a pivotally attached portion and which, upon rotating the panels to the position illustrated in FIG. 5, engages through aligning aperture 36 in panel 14 and in order to further assist in securing the panels together. Although not further shown, it is envisioned and understood that carrying handles can be formed in the nature of extending or looped portions projecting from outermost extending edges of the panels 12 and 14, or in any other suitable fashion to facilitate grasping and portability of the device.

Figure 2:
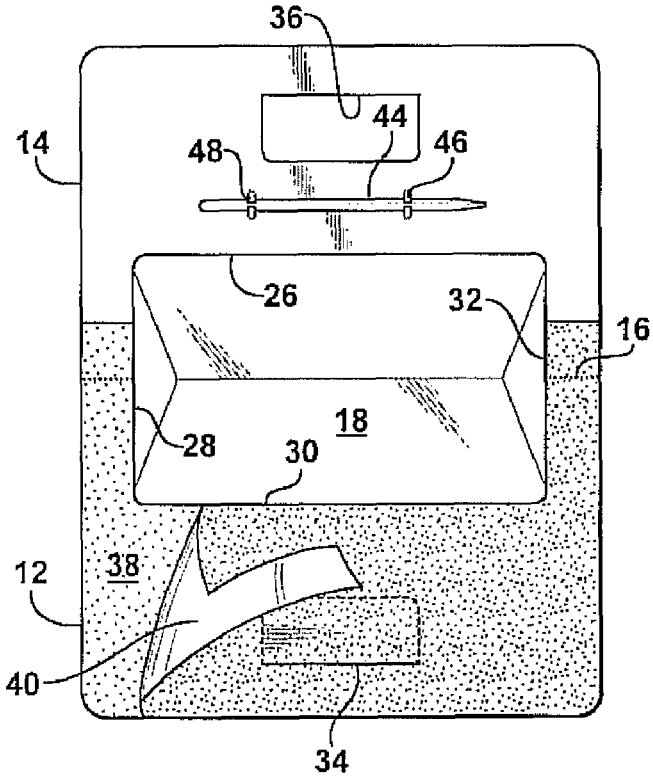
FIG. 2 is a top view of the blank incorporated into FIG. 1 and showing the feature of the tear-away adhesive strip for accomplishing sealing of the bag interior.

An adhesive surface is represented, see at 38 in FIG. 2, upon at least a portion, and typically all, of an opposing and inwardly facing surface of the first panel 12 (this further being defined as being the surface opposite that to which the bag 18 is secured). In the preferred embodiment illustrated, the adhesive backing extends to a portion of the second panel 14 just beyond the contiguous and hinged center line 16 and it is also envisioned that the adhesive may extend across the entire opposing faces of the first and second panels.

Figure 3:
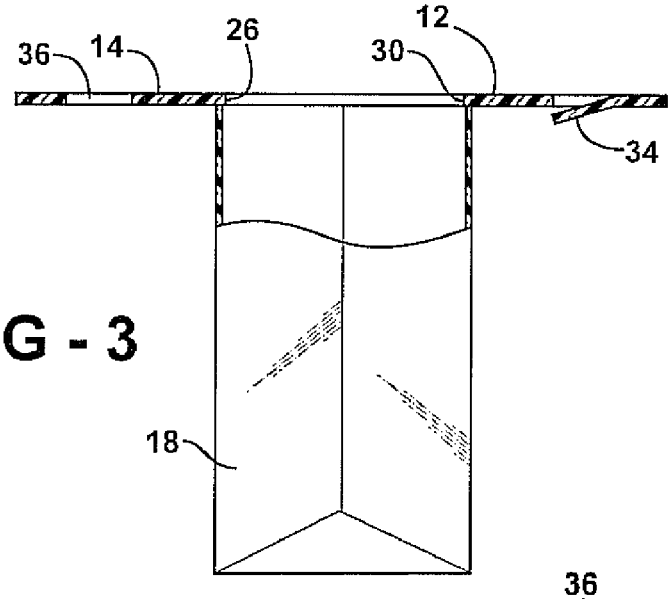
FIG. 3 is a cutaway side view illustration taken along line 3-3 of FIG. 1 and again illustrating the blank in a fully opened and loading position.
Figure 4:
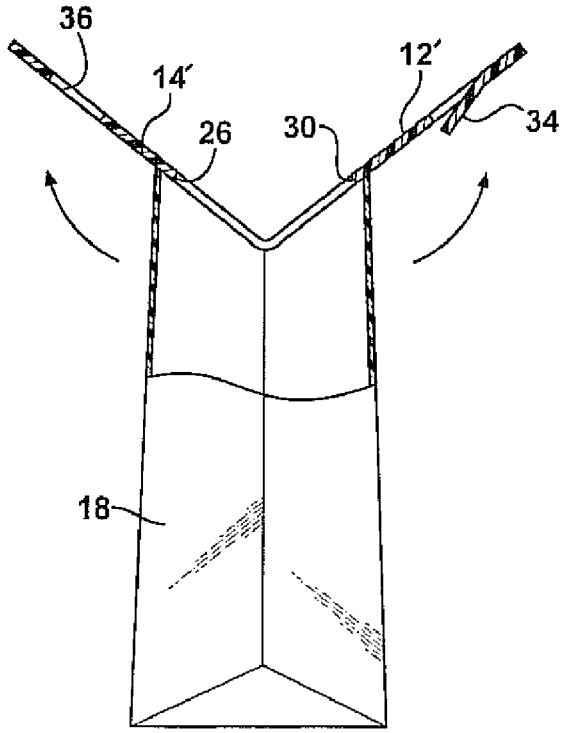
FIG. 4 is a succeeding side view illustration of the blank in a partially sealed condition.
Figure 5:
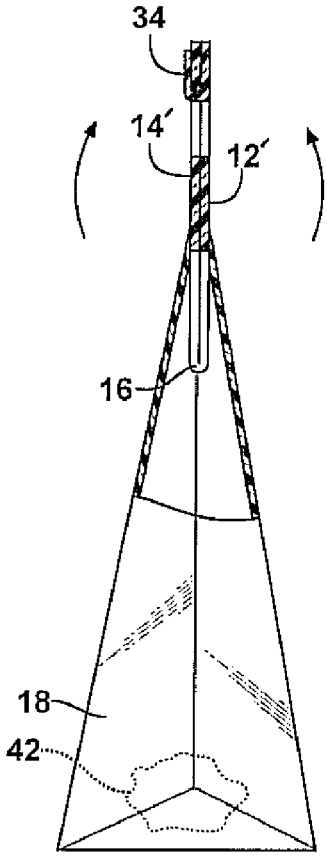
FIG. 5 is a further succeeding side view illustration of the blank in a fully closed and sealed position.

A peel-away strip 40 (see again FIG. 2) may be provided and which, upon being removed from the adhesive backing 38, permits the hingedly connected panels 12 and 14 to be pivoted, from the fully open position of FIG. 3, through the closing position (illustrated by intermediate positions 12' and 14' in FIG. 4), and to their closed and tamper-evident positions (see at 12" and 14" in FIG. 5) and upon pre-insertion of desired evidence items, see as further represented at 42 in FIG. 5. It is also envisioned that, within the scope of the present invention, the adhesive backing and peel-away strip can be substituted by other structure for securing together the opposing facing surfaces of the panels, these including the provisions of other types of mechanical or chemical based fasteners and including, without limitation, clips, heat staking portions and the like.

Referring again to FIGS. 1 and 2, an elongated wand element 44 (such as a sanitized pencil, chopstick or tike item) is secured to one of the panels, in this instance panel 14. The purpose of the wand may be twofold, firstly to provide for lifting and depositing of the evidence items in a non-contaminating fashion and, secondly, to provide a convenient writing utensil for recording information relevant to the evidence item, and such as which may be provided upon an indicia recording surface of the bag or blank for recording such information. In a preferred embodiment, the wand element 44 is releasably secured to a surface of the panel (again 12 or 14) and this may further include the provision at least one pair of opposing and biasingly resilient tabs, see pairs of tabs at 46 and 48, extending from a surface of said panel and which grippingly engages therebetween said wand.

Figure 6:
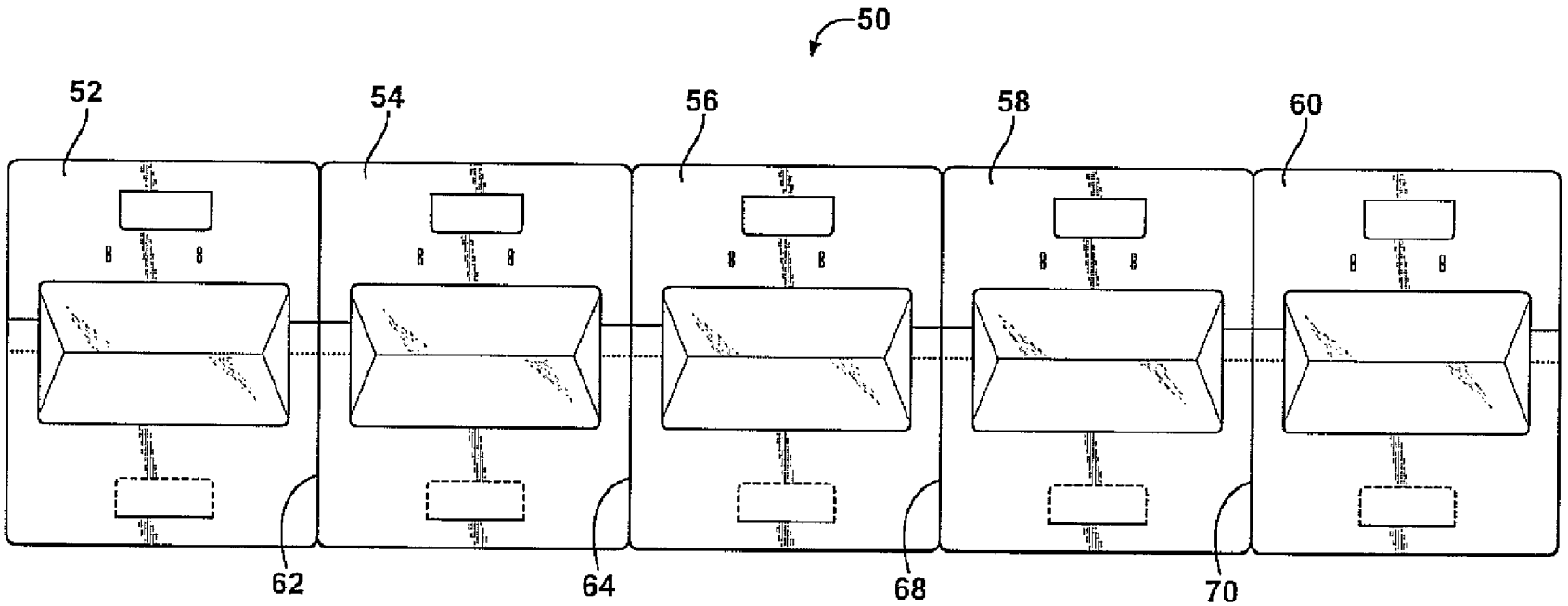
FIG. 6 is an illustration of a plurality of blanks and such as which may be produced according to a manufacturing process.

Referring further to FIG. 6, a general representation is shown at 50 of a plurality of blanks 52, 54, 56, 58 and 60. The blanks 52-60 each exhibit a specified shape and size (and such as which are substantially identical to those described in reference to FIGS. 1-5), the blanks further being detachable engaged together along selected and interconnecting edges, see at 62, 64, 66, 68 and 70 and such as which may be produced according to a manufacturing process.

The illustration of FIG. 6 is intended to illustrate that the blank design is usually produced separately from the bag (although the present invention also contemplates that the bag and blank can be produced together in certain embodiments). One envisioned manufacturing process contemplates a corrugated cardboard forming and stamping operation, succeeded by a cutting process for sectioning the individual blanks 52-60 at their interconnecting edges 62-70.

Figure 7:
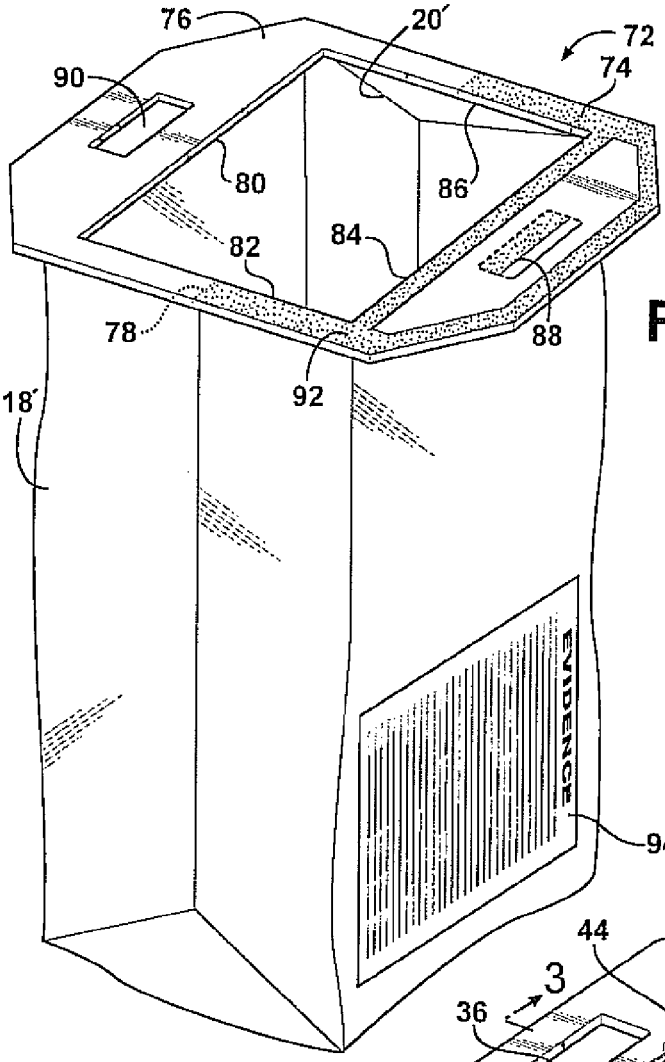
FIG. 7 is a perspective view of a foldable blank and evidence bag application according to a further preferred embodiment of the present invention and illustrating an evidence entry form such as which can be adhesively secured to a selected surface of the bag.

Referring to FIG. 7, a general illustration is shown at 72 of a foldable blank and evidence bag application according to a further preferred embodiment of the present invention. A blank is provided, similar in function to that described in FIGS. 1-5, with the exception that the hingedly connected panels 74 and 76 are reconfigured such that they define a larger central opening, see hinged center line 78 and inwardly lacing and aperture defining edges 80, 82, 84 and 86.

Handle portions 88 and 90 are formed in the panels 74 and 76 and, as also with the first disclosed embodiment, an adhesive backing 92 is applied to the first panel 74. The embodiment 72 of FIG. 7 is generally understood to qualify as a larger-sized tamper-evident and sealable bag and in order to secure and retain larger sized evidence items, and which is further characterized by a larger sized bag 18' with open perimeter edge 20'.

Also illustrated in FIG. 7 is the provision of evidence entry form 94 (see also FIG. 11), and such as which is capable of being secured to such as an opposite surface of the bag material in order to document the initial evidence entry particulars. As further referenced in FIG. 11, a listing of such fields include for: Property/Evidence Envelope: Date, From Who Obtained, Where Obtained, Defendant, Alias, D.O.B., Address, Social Security Number, Birthplace, Date of Offense, Sex, Race, Height, Weight, Hair, Eyes, Co-Defendant 1, Co-Defendant 2, Complaint No., District of Arrest, Date/Time, Charge, District of Arrest No., Property Book, description of Evidence, Where Obtained, Seized By, Assigned To, Purchased By, Amount Paid, Collected By, and Assigned by. Additional fields relevant to the person recovering and sealing evidence include those for: Sealed By: Signature, Date, Time, Print Name, Assigned, Picket Up By, Location Picked Up, Date, Time, Witness, Lab No., Received By, Work Unit, Date and Time.

The purpose of the various data entry fields is to provide a written record of all of the particulars relating to the original evidence collection and retention, such as associated with a criminal event. That said, situations often exist where retrieval of the evidence is required, such as during an ongoing criminal legal investigation or court action, and in which the access to evidence during discovery or at trial is needed, such as in order to confirm or refute a suspect's alibi and/or to substantiate an issue of fact supporting a legal position taken by the prosecution in seeking to establish a charge against the suspect being charged.

Figure 8:
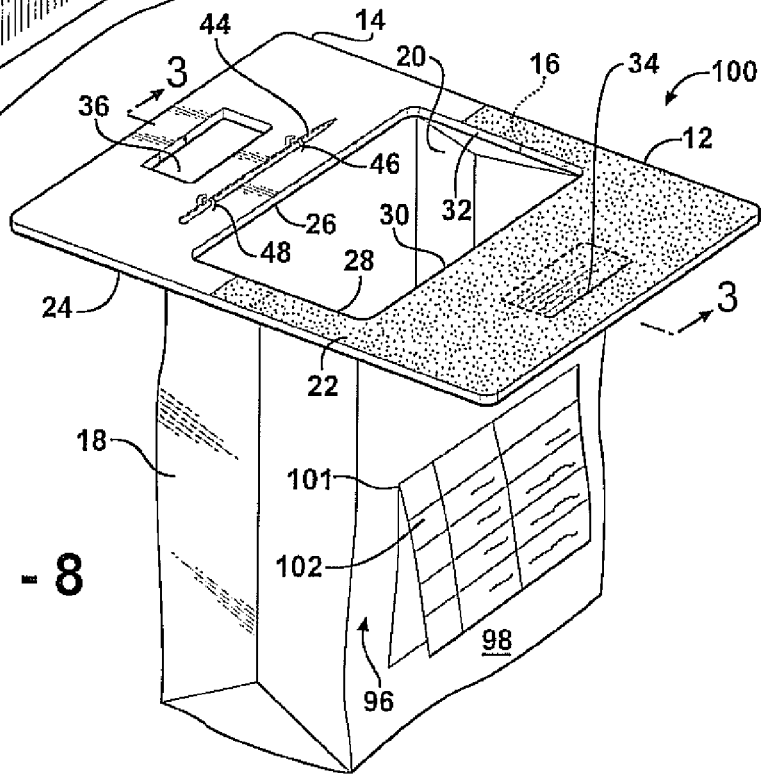
FIG. 8 is an illustration similar to that shown in FIG. 1 and further exhibiting the features associated with the evidence re-entry and subsequent tamper-evident reclosure structure, associated with a side of the bag, and which enables documentation of an evidence retrieval and subsequent resealing event.
Figure 9:
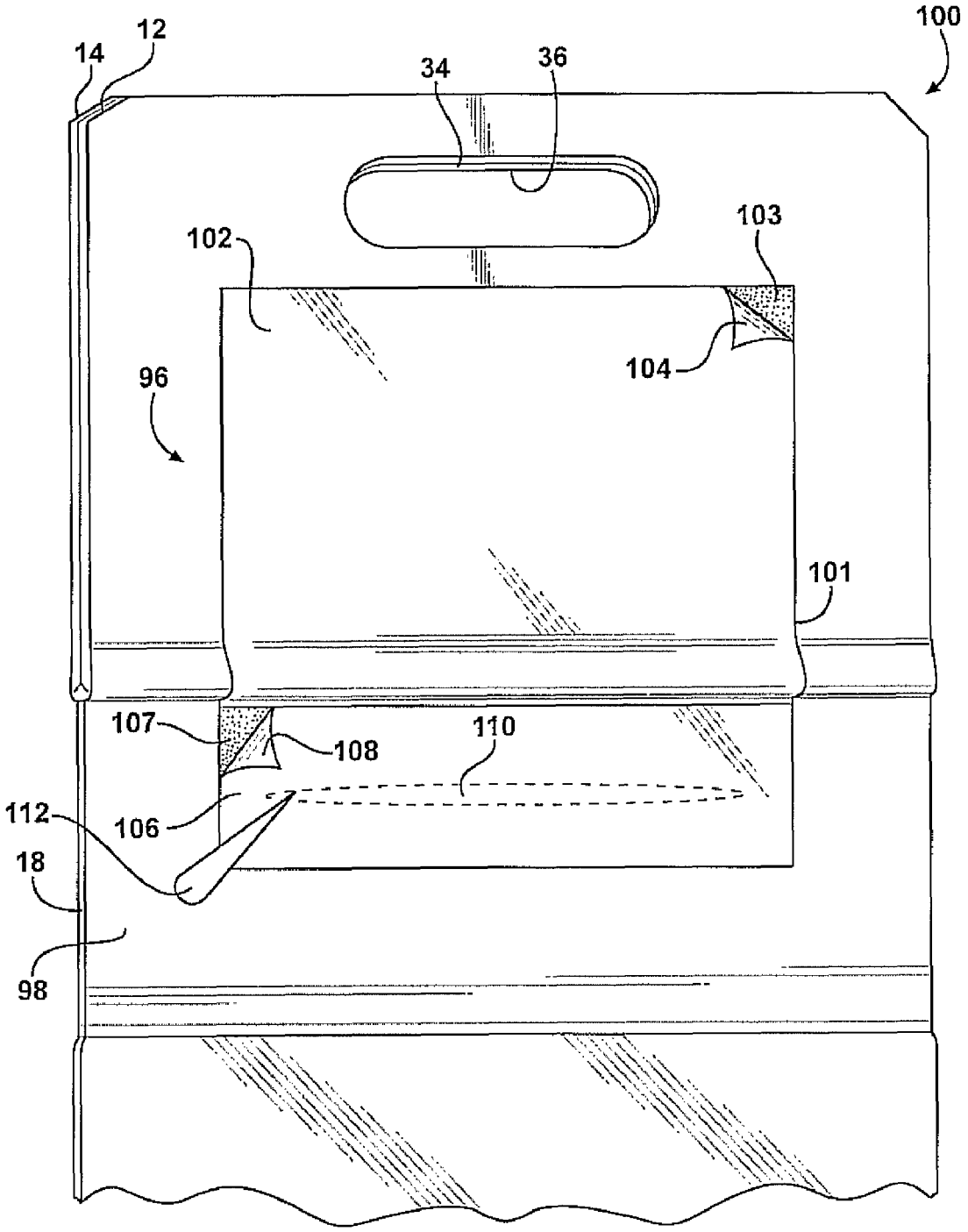
FIG. 9 is a substantially collapsed plan view of a combination bag and blank, such as shown in FIG. 8, and illustrating the features of an incising/evidence accessing and adhesively covered portion, as well as an interconnecting and fold-over flap portion for tamper-evidently resealing the first surface and for providing documentation associated with the evidence retrieval event.
Figure 10:
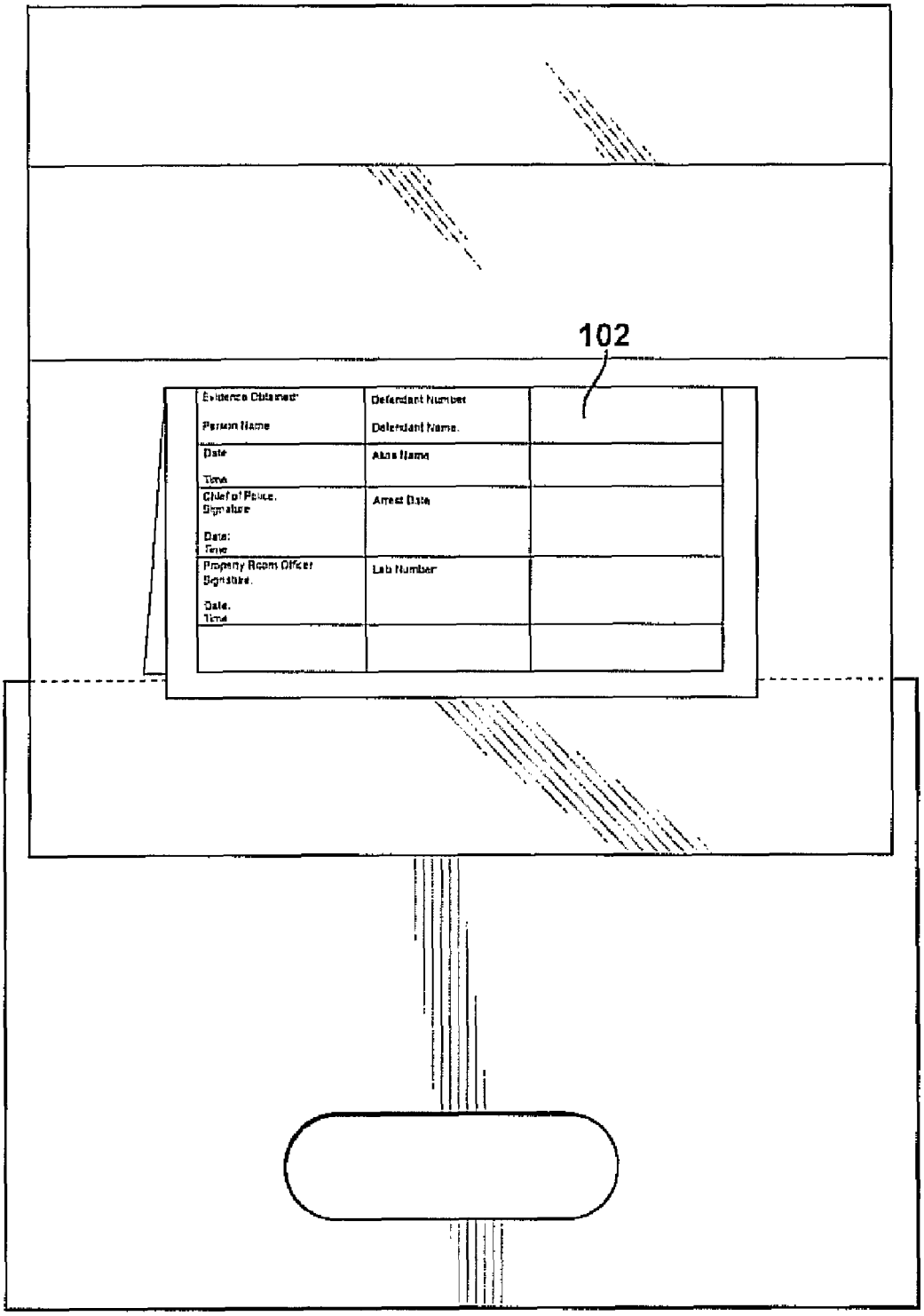
FIG. 10 is a rotated view to that shown in FIG. 9 and further illustrating the flap portion adhesively applied over the incising/evidence accessing portion including recordable information fields for documenting the particulars of the re-entry and subsequent tamper evident-resealing event.

Collectively referenced, FIGS. 8-10 illustrate a features associated with an evidence re-entry and subsequent tamper-evident reclosure structure (generally referenced at 96), associated with a side 98 of a reconfigured bag, generally at 100, and which enables documentation of an evidence retrieval and subsequent resealing and documentable re-entry of the pre-sealed evidence bag. Referring also to FIGS. 9 and 10, the tamper-evident resealing structure includes a pivotally secured (see hinged location 101 in FIGS. 8 and 9) and re-closable panel/flap 102, a surface of which exhibiting an adhesive covering 103 and upon which is configured an adhesive peel away layer 104 (FIG. 9).

Upon being reclosably folded over a previously incised bag face (at 98), a reverse face (see FIGS. 8 and 10) of the flap 102 includes a series of data fields relevant to the evidence re-entry event, these including for: Evidence Obtained, Person Name, Defendant Number, Defendant Name, Date, Time, Alias Name, Chief of Police Signature, Date, Time, Arrest Date, Property Room Officer Signature, Date, Time and Lab Number. The above referenced and recordable information fields are in particular for documenting the particulars of the re-entry and subsequent tamper evident-resealing event and are separate and in addition to the initial resealing structure described in FIGS. 1-7, as well as the evidence entry form 94 previously discussed and utilized to document the initial evidence entry particulars.

FIG. 9 is a substantially collapsed plan view of a combination bag and blank, such as shown in FIG. 8, and illustrating the features of an incising/evidence accessing portion 106, this located in hinged (e.g. at 101 in FIG. 9) proximity to the interconnecting and fold-over flap 102 for tamper-evidently resealing the bag surface (previously identified at 98) and for providing for documenting the circumstances associated with the evidence retrieval event. An additional adhesive 107 can be applied to the portion 106, and which may further reference a secondary peel-away covering 108. That said, the provision of a secondary adhesive is optional, the overlaying securing of the hingedly connected and adhesively faced flap 102 (upon removal of the peel away layer 104 in order to reveal the adhesive backing 103) accomplishing covering of the previously knife cut or incised portion (see further at 110) and which can be opened through the application of any pointed or sharp edged object, such as a knife 112 shown in FIG. 9 and in order to retrieve objects of evidence previously collected, recorded and stored in the bag.

As again referenced in FIG. 10, and upon rotating the flap 102 to an overlaying fashion relative to the incised portion 110 previously made in the evidence accessing portion 106, again from the position previously shown in FIG. 9. The flap 102 is adhesively engaged over the incising/evidence accessing portion, at which point the recordable information fields previously described are filled out for documenting the particulars of the re-entry and subsequent tamper evident-resealing event.

An associated manufacturing process for creating the evidence bag with tamper evident reclosable structure may also include transferring a large number of substantially completed bag along a conveyor, upon which the layers of adhesive 103 and 107 are applied to the flap 102 and adjoining incising/evidence accessing portion 106. An additional step may include applying a knife edge in a partially scribing, but not totally, incising fashion along a determined length of the accessing portion 106 and in order to define a location along portion 106 which will remain normally closed, however can be subsequently and completely incised and opened through the application of any sharp edge object, such as to permit documented retrieval of previously stored articles of evidence.

It is also envisioned that additional tamper evident resealing structures, such as illustrated in FIGS. 8-10 upon one dedicated side (98) of the evidence bag, may also be employed, such as along an opposite bag side (hidden from view in FIG. 8). Additionally, and depending upon the size of the evidence bag and the perceived likelihood that multiple (and documented) evidence entry events may be required, it is also envisioned that more than one tamper evident resealing structure may be placed upon a given bag surface (or side 98), and which will enable an authorized individual to access evidence and, such as after replacement of the same, record the particulars of each entry event.

The bag material further typically includes such as a Kraft paper, this exhibiting a number of desired properties associated with evidence retention, not limited to a providing a controlled degree of breath-ability (this contemplated to include both fluid absorbance and waterproof characteristics) in order to avoid short and medium term compromising of fluidic retaining articles of evidence, the integrity of which may be required at trial. It is also envisioned that the thickness of the paper can be varied, dependent upon the type of evidence intended to be stored within the bag.

Having described my invention, other and additional preferred embodiments will become apparent to those skilled in the art to which it pertains, and without deviating from the scope of the appended claims.

I claim:

1. A tamper-evident evidence bag, comprising:

a blank having first and second planar shaped and pivotally connected panels;

a bag having an open perimeter edge and which is secured to first selected facing surfaces of said pivotally connected panels, and such that an interior of the bag is communicable through an aperture defined between said panels;

said first and second panels being folded from an open position, in which said panels are established in a substantially parallel relationship, to a closed position, in which opposingly facing surfaces of said panels are adhered against one another and in order to maintain, in tamper-evident fashion, items placed within the bag enclosure;

an evidence accessing portion integrally formed with a selected location of said bag and which is adaptable to being incised in order to retrieve objects of evidence previously collected, recorded and stored in said bag; and additional tamper-evident resealing structure located in proximity to said evidence accessing portion and exhibiting adhesive resealing and documentable re-entry fields, said tamper-evident resealing structure further comprising a flap hingedly secured along an exterior surface of said bag, a face of said flap exhibiting an adhesive backing covered by a peel away layer, said evidence accessing portion being in proximity to said flap such that, upon incising an extending length along said evidence accessing portion, said flap being rotated over said accessing portion and adhesively sealed against said selected location in an additional tamper-evident fashion.

2. The invention as described in claim 1, further comprising a second peel away layer applied to said evidence accessing portion.

3. The invention as described in claim 1, further comprising an evidence entry form located upon a further exterior surface of the bag material in order to document initial evidence entry particulars.

4. The invention as described in claim 1, further comprising an adhesive surface covering at least a portion of one of said opposing facing surfaces associated with a selected panel.

* * * * *